US005383524A

United States Patent [19]

Rinnemaa

[11] Patent Number: 5,383,524

[45] Date of Patent: Jan. 24, 1995

[54] METHOD AND EQUIPMENT FOR ALIGNING THE FEEDING BEAM OF A ROCK DRILLING EQUIPMENT

[75] Inventor: Heikki Rinnemaa, Tampere, Finland

[73] Assignee: Tamrock Oy, Tampere, Finland

[21] Appl. No.: 30,406

[22] PCT Filed: Oct. 7, 1991

[86] PCT No.: PCT/FI91/00306

§ 371 Date: Mar. 29, 1993

§ 102(e) Date: Mar. 29, 1993

[87] PCT Pub. No.: WO92/06279

PCT Pub. Date: Apr. 16, 1992

[30] Foreign Application Priority Data

Oct. 8, 1990 [FI] Finland ..... 904937

[51] Int. Cl.[6] ..... E21C 11/00

[52] U.S. Cl. ..... 173/1; 173/190

[58] Field of Search ..... 173/1, 42, 44, 190, 173/193, 195

[56] References Cited

U.S. PATENT DOCUMENTS

| | | | |
|---|---|---|---|
| 4,288,056 | 9/1981 | Bergström | 173/195 |
| 4,343,367 | 8/1982 | Mashimo | 173/190 |
| 4,484,637 | 11/1984 | Mayer | 173/190 |
| 4,499,953 | 2/1985 | Molin | 173/44 |
| 4,514,796 | 4/1985 | Saulters et al. . | |
| 4,601,000 | 7/1986 | Montabert . | |
| 4,698,570 | 10/1987 | Satoh | 173/193 |

FOREIGN PATENT DOCUMENTS

| | | |
|---|---|---|
| 54543 | 8/1978 | Finland . |
| 830008 | 7/1983 | Finland . |
| 2519690 | 4/1984 | France . |
| 3902127A1 | 7/1990 | Germany . |
| 133242 | 12/1975 | Norway . |
| 392319 | 3/1977 | Sweden . |
| 412431 | 3/1980 | Sweden . |
| 1325240 | 8/1973 | United Kingdom . |

*Primary Examiner*—Scott A. Smith

*Attorney, Agent, or Firm*—Nixon & Vanderhye

[57] ABSTRACT

A method of aligning the feeding beam (6) of a rock drilling equipment by gravity-operated sensors (7x, 7y) indicating the inclination of the feeding beam (6). In the method, the angle values ($\alpha$, $\beta$) of the feeding beam (6), indicating by the sensors (7x, 7y) are corrected so that they correspond to the actual angles of inclination of the feeding beam (6). The rock drilling equipment comprises two gravity-operated angle sensors (7x, 7y) measuring inclination in two planes perpendicular to each other. The equipment further comprises a calculator (8) which calculates a difference between the angle value of one angle sensor (7x, 7y) and the actual angle of inclination of the feeding beam (6) in the direction in question on the basis of the angle value obtained by the other angle sensor (7y, 7x) and corrects the value so that it corresponds to the actual inclination of the feeding beam.

6 Claims, 3 Drawing Sheets

METHOD AND EQUIPMENT FOR ALIGNING THE FEEDING BEAM OF A ROCK DRILLING EQUIPMENT

TECHNICAL FIELD

The invention relates to a method of aligning the feeding beam of a rock drilling equipment with a hole to be drilled, wherein the inclination of the feeding beam is measured in the direction of two vertical measuring planes at an angle with respect to each other by means of two gravity-operated sensors responsive to the position of the feeding beam, each sensor indicating the inclination of the feeding beam in the direction of one of the planes, and the feeding beam is turned so as to position the drill rod in a desired drilling direction by adjusting the inclination of the feeding beam with respect to the measuring planes on the basis of the values of the angles of inclination obtained by means of the sensors.

The invention is also concerned with rock drilling equipment for realizing the method described above the equipment comprising a carrier, a boom mounted to the carrier rotatably by means of joints, and a feeding beam for a drilling machine, the feeding beam being mounted to the end of the boom turnably about joints perpendicular to each other, two gravity-operated inclination sensors for measuring the inclination of the feeding beam with respect to two vertical measuring planes at an angle with respect to each other, and display means for indicating inclination angle values measured by the sensors.

BACKGROUND

To drill holes in rock, the feeding beam is positioned in parallel with a plane defined by the row of holes to be drilled, especially when loosening rock for further processing. Similarly, in some cases, it is desirable to drill holes in systematic, regular fields in order to be able to perform the blasting as efficiently and accurately as possible. To drill a row of holes in a predetermined direction, the drilling direction is usually determined in x and y planes vertical and perpendicular to each other. Typically, the object is to carry out the drilling in such a way that the y plane is parallel to the longitudinal axis of the carrier, and the x plane is perpendicular to it in order that the drill rod could be positioned more easily in a desired direction. The positioning is typically carried out by means of aligners of different types.

To determine the position of the feeding beam, it is known to use gravity-operated sensing means, whereby the purpose is to detect the direction of the feeding beam with respect to the vertical direction. Such means are described e.g. in SE Patent 392 319, which discloses a sensor box attached to the feeding beam and containing a gravity-operated sensor. This sensor box provides both x-direction and y-direction angle display on a screen positioned in front of the driller. In order to allow for the direction of the boom with respect to the carrier, the sensor box is attached to the feeding beam rotatably about an axis parallel to the drill rod, and the driller can turn the sensor box in proportion to the turning of the boom in such way that the measuring directions of the sensors remain unchanged in relation to the original vertical plane.

GB Patent 1 325 240, in turn, discloses an arrangement in which the feeding beam comprises a control valve, which is operated in response to by a gravity-operated weight sensor and which controls the turning cylinders of the feeding beam during the movement of the boom in such a way that the position of the feeding beam remains substantially unchanged. In this arrangement, the feeding beam and thus the drill rod are first turned to a desired angular position with respect to the end of the boom, whereafter the gravity-operated control valve is positioned vertically and fastened in place. When the displacement of the boom causes the position of the feeding beam to deviate from the original position, the gravity-operated sensor connects one or more of the cylinders turning the feeding beam in operation until the feeding beam has returned to its original direction.

It is also known e.g. from U.S. Pat. No. 4,514,796 and FR Patent 82 00 648 to calculate the direction of the drill rod with respect to the carrier of the drilling equipment by means of various sensors, whereas the direction of the drill rod with respect to the surface of the earth or the force of gravity is not determined in any way, whereby the position of the carrier is not taken into account in any way.

A drawback of the known arrangements is that the alignment is difficult as solely the x and planes can be utilized. The control of the equipment is difficult and the driller has to perform mechanical adjustments and other measures to ensure reasonably successful alignment. The equipments do not reckon with the angle error occurring in cases where the feeding beam is turned both in x and y direction. With known arrangements, angle errors are avoided only when the Turning axes of the feeding beam are turned fully in parallel with the x and y planes, whereby the apparatus has to be displaced for each hole in such a way that the longitudinal direction of the boom is parallel with the y axis or by utilizing a separate additional joint by means of which the feeding beam and its conventional turning joints can be turned in such a way that they are parallel with the x and y planes. The additional joint construction required in the latter case is heavy and expensive, in addition to which additional sensing means are needed to be able to allow for the direction in every case. Moreover, this construction makes the equipment difficult to control and causes extra strains to be exerted both on the boom and the other structures. Furthermore, the known arrangements do not allow for the error caused by the inclination of the carrier when the inclination of the feeding beam is determined by means of sensors responsive to the force of gravity. Finally, the equipments presently in use do not enable accurate determination of drilling depth, but the drilling depth has To be calculated separately while taking into account the inclination of the plane.

SUMMARY OF THE INVENTION

The object of the present invention is to provide a method and an equipment which avoids the problems described above and by means of which the alignment of both the feeding beam and the drill rod and, if required, the drilling depth can be determined and realized reliably and, if required, fully automatically.

This is achieved by means of a method according to the invention in such a way that the angle value indicated by the sensor is corrected by calculation in such a way that it corresponds to the actual angle of inclination of the feeding beam by allowing for the influence of an error caused by the inclination of the feeding beam in the other measuring plane at an angle with respect to the measuring plane of the sensor, and that the feeding beam is aligned in a predetermined direction on the basis of the angle value of the sensor after the value has been corrected by calculation so that it corresponds to the actual angle of inclination.

The basic idea of the method according to the invention is that the inclination of the feeding beam with respect to the surface of the earth is measured by means of two sensors measuring inclination in planes perpendicular to each other. The difference between the angle values obtained by the sensors and the actual angle of the feeding beam in the direction of a predetermined plane is compensated for by calculating this error, that is, the difference between the angle value of one sensor and the actual angle of the feeding beam in the measuring plane of this sensor, the error being caused by the fact that the feeding beam is also inclined in the direction of the other plane. According to one preferred embodiment of the invention, the inclination of the feeding beam with respect to the boom is measured separately by means of separate sensors in such a way that the inclination in the y direction is measured as the turning angle of the joint between the boom and the feeding beam, which turning angle is independent of the x angle. The x angle is measured with respect to the joint between the feeding beam and the boom and is corrected by calculation to obtain the actual x angle, taking into account the angle error caused by the y angle. If the boom deviates from the direction of the y plane, the corresponding mathematical corrections are made both in the y angle and on the basis of it in the x angle to achieve the actual direction angles. Thus the direction of the drill rod and the feeding beam can always be determined as actual direction angles, and this can be effected mathematically in such a manner that the driller can read the actual angles on the screen, or the set angles are fed to the equipment, and so it always calculates the actual angles and adjusts the feeding beam in accordance with the preset angle values. Similarly, the drilling can be performed by determining it in a cylindrical coordinate system by determining a deviation angle relative to the y-axis and an inclination angle relative to a vertical axis parallel to the force of gravity in this direction, whereby the drilling is easy to adjust and realize irrespective of variation in the wall to be drilled and the position of the carrier.

The equipment according to the invention is characterized in that it comprises a calculator with a calculating device for correcting the angle value indicated by at least one of the sensors by calculating so that it corresponds to the actual angle of inclination of the feeding beam by taking into account the influence of the inclination of the feeding beam in a measuring plane at an angle with respect to the measuring plane of the sensor on the angle value of the sensor; and a control unit for aligning the feeding beam in a predetermined direction on the basis of the angle values corrected by calculation.

The basic idea of the equipment according to the invention is that the inclination of the feeding beam with respect to the force of gravity, that is, with respect to the surface of the earth, is measured by means of two sensors in two planes perpendicular to each other and parallel to the force of gravity, that is, perpendicular to the surface of the earth, and that the equipment comprises a calculator which calculates an error or a difference between the angle value obtained by the sensor and the actual inclination of the feeding beam. The error is due to the fact that the feeding beam is also inclined in the second measuring plane perpendicular to the first measuring plane. The calculator then displays the actual inclination of the feeding beam obtained through calculation. The basic idea of one preferred embodiment of the equipment according to the invention is that the inclination is measured in the longitudinal direction of the boom by means of a separate gravity-operated sensor, and so the angle value obtained by this sensor is independent of the other inclination angle of the feeding beam. Further, the inclination of the feeding beam in the transverse direction of the boom is measured by means of a second gravity-operated sensor, and the angle value obtained by this sensor can then be corrected by calculation on the basis of the angle value obtained by the first sensor so that the actual angle value in the transverse direction is obtained. Furthermore, in the preferred embodiment of the equipment according to the invention, the calculating means are arranged to calculate the corrected angle values on the basis of the angles between the boom and the carrier and the geometry of the boom, that is, the length of its parts and the angles of the boom joints, i.e. the angle values obtained by angle sensors provided in the joints, and the geometrical length values set in the calculating means both when the feeding beam turns in the longitudinal direction of the boom and in a direction transverse to it, whereby the actual angle values are always obtained with respect to the defined basic planes when drilling holes in a row in a predetermined direction.

DETAILED DESCRIPTION OF THE DRAWINGS

Figure 1:
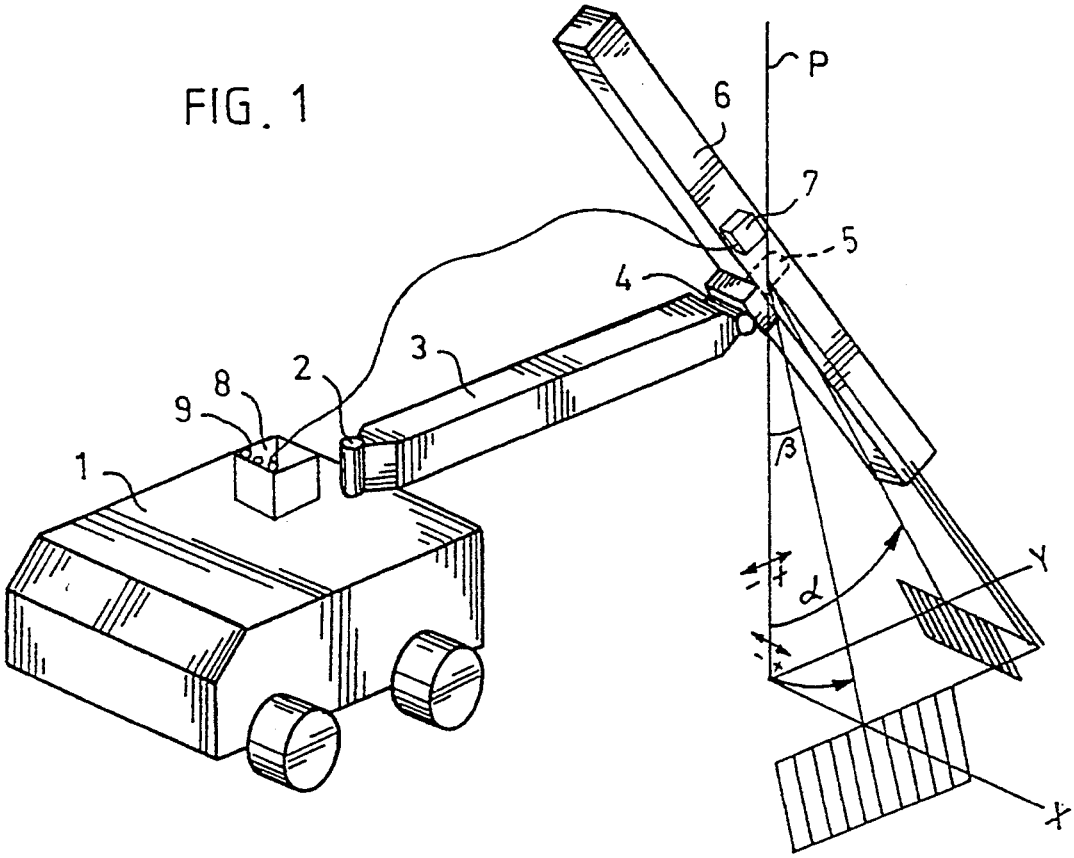
FIG. 1 is a schematic perspective view of a rock drilling equipment according to the invention when the method is applied for determining the inclination of the feeding beam by means of x and y planes perpendicular to each other.

FIG. 1 shows schematically a rock drilling equipment comprising a carrier 1, to which a boom 3 is mounted rotatably about a vertical axis on a vertical joint 2. A feeding beam 6 is attached to the end of the boom 3 rotatably about a horizontal axis 4 and about an axis 5 perpendicular to the axis 4, a drilling machine with a drill rod being arranged to move along the feeding beam 6 in the direction of its longitudinal axis in a manner known per se, which will not be described more closely herein.

A sensor box 7 containing gravity-operated sensors 7x and 7y known per se is attached to the feeding beam 6. The structure and operation of the sensors are known per se, and the sensors may operate similarly as or utilize the same principle as e.g. the gravity-operated sensors disclosed in SE Patent 392 319. In FIG. 1, a vertical line defined by the force of gravity is indicated with the reference P; in the case of this figure, the carrier 1 is in a horizontal position, that is, the plane defined by the carrier is perpendicular to the line P. Similarly, a first measuring plane to be used in the inclination measurement, i.e. a y plane, is parallel to the longitudinal axis of the boom 3 and to the line P, and so the sensor 7y indicates the inclination of the feeding beam in the y plane as an angle $\alpha$ between the longitudinal axis of the feeding beam and the vertical line P. Correspondingly, a second measuring plane, i.e. an x plane is perpendicular to the y plane and parallel to the line P, and the sensor 7x indicates the inclination of the feeding beam in the x plane as an angle $\beta$ between the longitudinal axis of the feeding beam and the line P. When the feeding beam is inclined solely in the direction of one measuring plane, such as the y plane, the sensor of this plane indicates accurately the inclination of the feeding beam. When the feeding beam is additionally turned in the direction of the x plane, the sensor 7y gives a greater angle value even though the angle actually remains unchanged in the direction of the y plane. As a consequence, when calculating the actual direction of the feeding beam, the influence of the inclination in the direction of the other plane has to be taken into account in order to avoid erroneous drilling direction. In FIG. 1, the situation has been simplified in many respects. For the sake of clarity, it is assumed that the carrier 1 is in the horizontal position and that the boom 3 is parallel to the plane of the carrier. The equipment according to the invention comprises a calculator unit 8 to which the angle sensors contained in the sensor box 7 are connected and which calculates the actual inclination angle of the feeding beam on the basis of the angles $\alpha$ and $\beta$ measured by the two sensors. A display device 9 attached to the calculator unit 8 shows the actual direction of the feeding beam, whereby the feeding beam can be turned in desired directions by control means known per se and therefore not shown until its actual calculated angle values and the angle values of a predetermined drill hole direction are equal.

Figure 2:
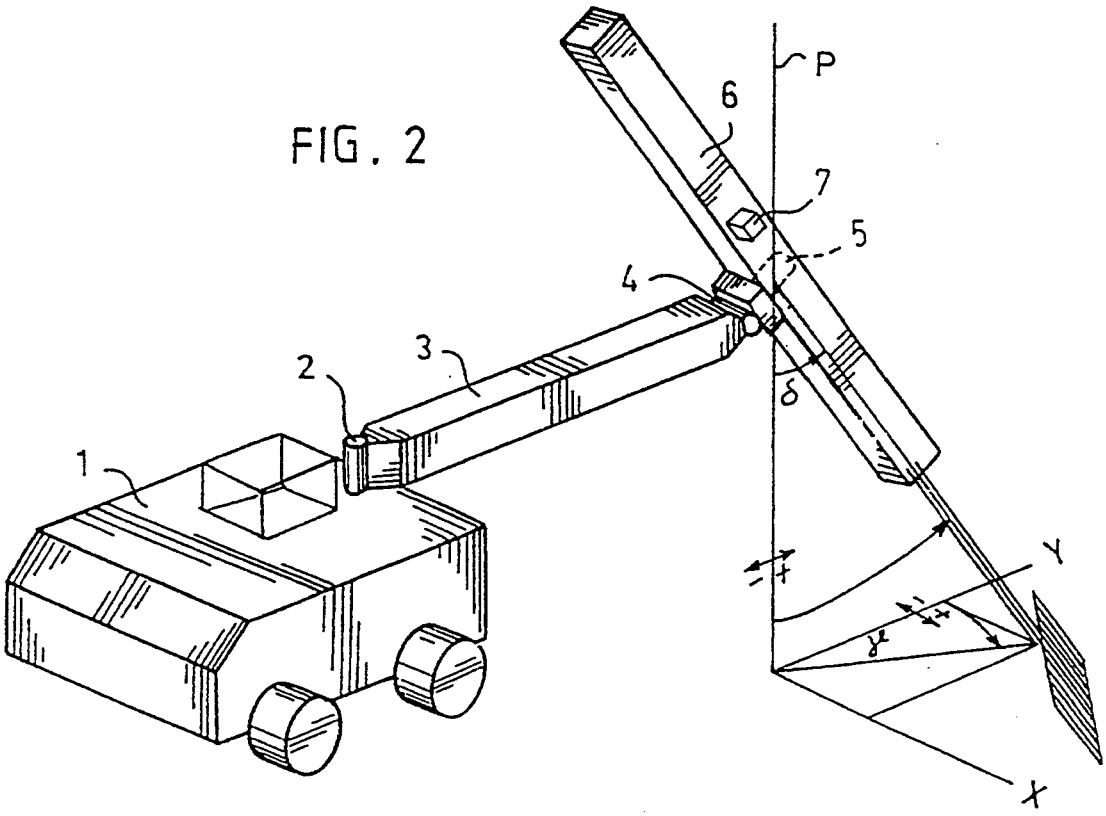
FIG. 2 is a schematic perspective view of a rock drilling equipment according to the invention when the inclination of the feeding beam is determined as a direction angle and as an inclination in a plane defined by the direction angle.

FIG. 2 shows a simplified drilling equipment similar to that shown in FIG. 1. In FIG. 2, the direction of the feeding beam 6 is measured by means of the inclinations of the x and y planes defined similarly as in FIG. 1. However, the direction of the longitudinal axis of the feeding beam is defined in a cylindrical coordinate system, in which the longitudinal axis has a direction angle $\gamma$ which is defined in a plane perpendicular to the line P, that is, substantially in the plane of the surface of the earth beginning from the y plane, and further as a turning angle $\delta$ of the longitudinal axis of the feeding beam 6 away from the line P in a plane defined by the direction angle $\gamma$ and the line P.

Figure 3:
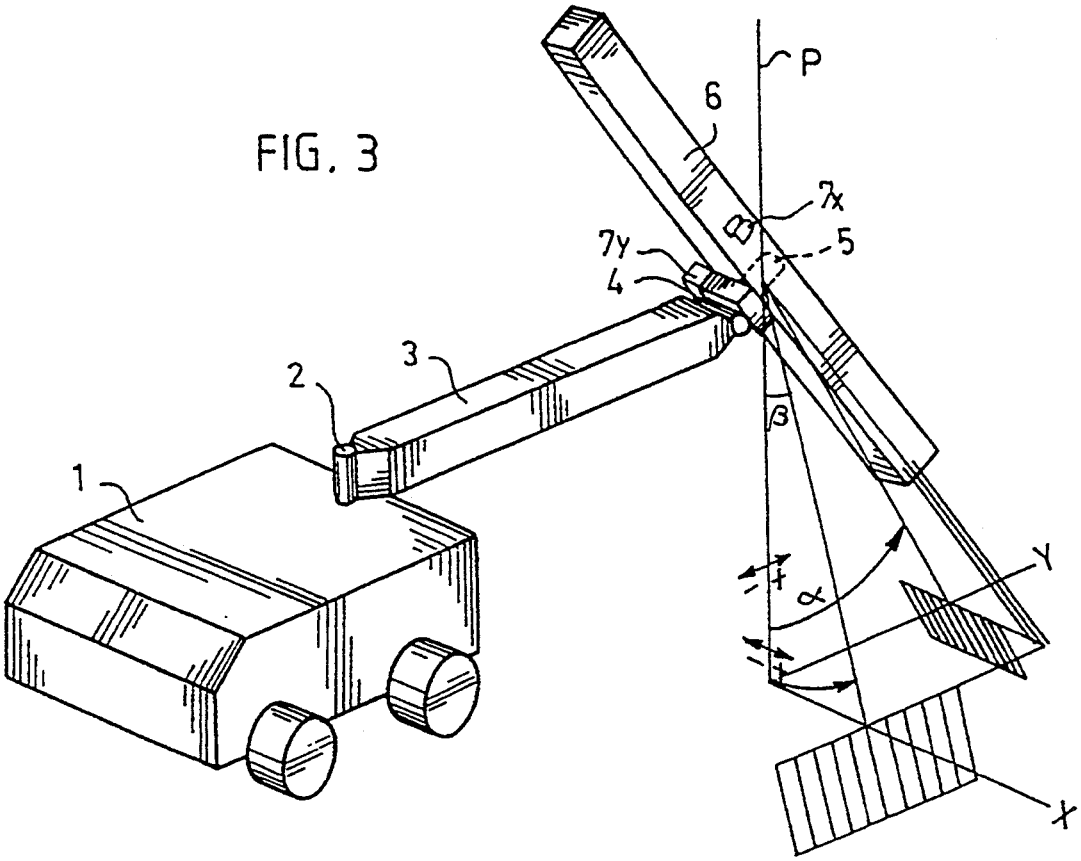
FIG. 3 is a schematic perspective view of a rock drilling equipment according to the invention when the inclination of the feeding beam is measured by means of two separate sensors, one of which is arranged to measure the inclination of the feeding beam in the longitudinal direction of the boom and the other in its transverse direction.

FIG. 3 shows a simplified arrangement in accordance with FIG. 1. In FIG. 3, the sensor 7x determining the inclination in the x plane and the sensor 7y determining the inclination in the y plane are mounted separately so that the sensor 7x is positioned at the side of the feeding beam 6 so that it reacts to inclination changes in both the x plane and the y plane, whereas the sensor 7y is positioned between the feeding beam 6 and the boom 3 so that it is affected only by an inclination change taking place about the axis 4 in the y plane. This simplifies the calculation, since changes in the angle values in the y plane have to be taken into account only in the angle values of the x plane, whereas the values in the y plane are correct irrespective of changes taking place in the x plane.

Figure 4:
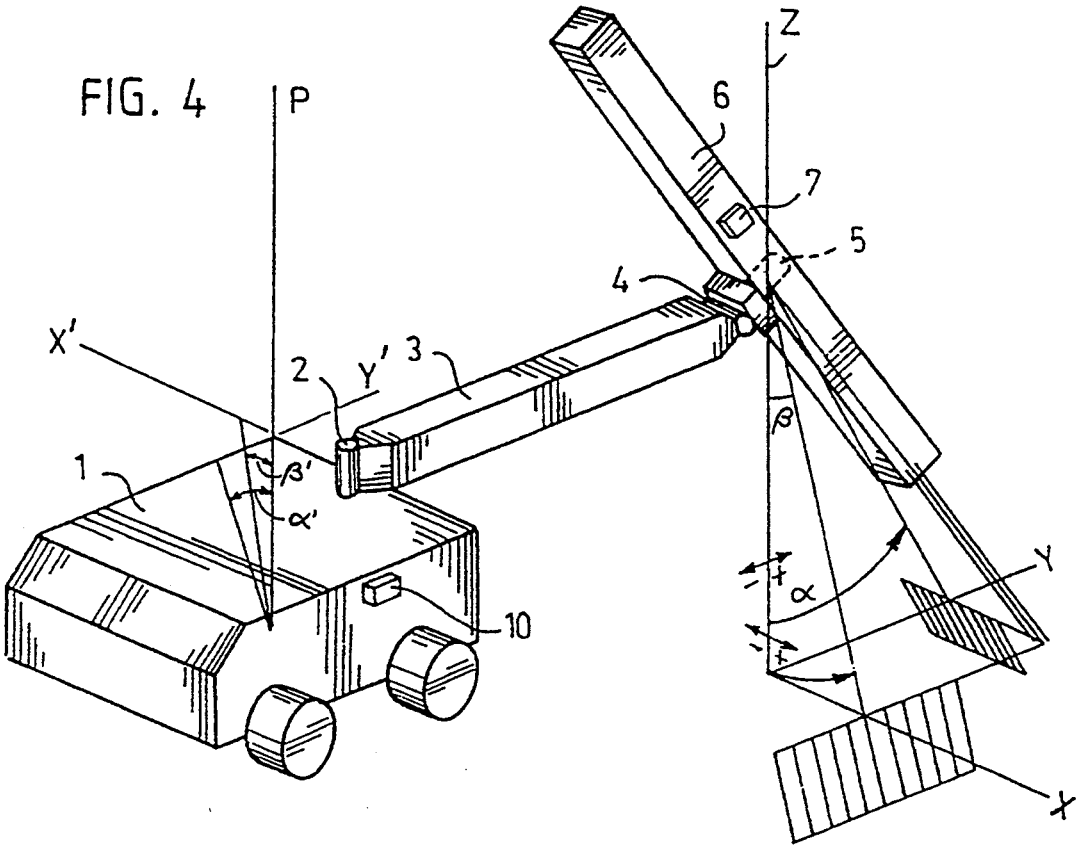
FIG. 4 is a schematic perspective view of the measurement of the inclination of the feeding beam when separate gravity-operated sensors indicating inclination with respect to the surface of the earth are provided in the carrier of the rock drilling equipment.

FIG. 4 shows schematically another embodiment of the invention, in which a sensor box 10 containing angle sensors is attached to a carrier 1, whereby the sensor box indicates the inclination of the carrier 1 as an angle $\alpha'$ with respect to a line P defined by the force of gravity in a third measuring plane or an y' plane defined by the line P and the longitudinal axis y' of the carrier 1, and correspondingly as an angle $\beta'$ with respect to the line P in a fourth measuring plane or an x' plane perpendicular to the plane y' defined by the line P. By means of the angle values $\beta'$ and $\alpha'$ so obtained and by utilizing the turning angle of the joint 2 of the boom 3 about the joint 2 and the geometrical length values of the boom, it is possible to calculate the position of the end of the boom 3 close to the feeding beam 6 as well as the direction and inclination of the boom, whereby the position of a reference point defined in the end of the boom 3, that is, the joint point of The feeding beam, with respect to the hole to be drilled is known. At the same time, it can be calculated how much the y plane in the longitudinal direction of the boom and the x plane perpendicular to the y-plane, the sectional line Z of which is perpendicular to the plane of the carrier, deviate from the line P defined by the force of gravity. Further, the angle values obtained by the angle sensors 7y and 7x can be corrected by calculation in such a way that the angle values representing the direction and inclination of the feeding beam are determined correctly with respect to the line P defined by the force of gravity. Thereafter the feeding beam can be directed by means of the control means in accordance with the predetermined angle values either manually or automatically.

Figure 5:
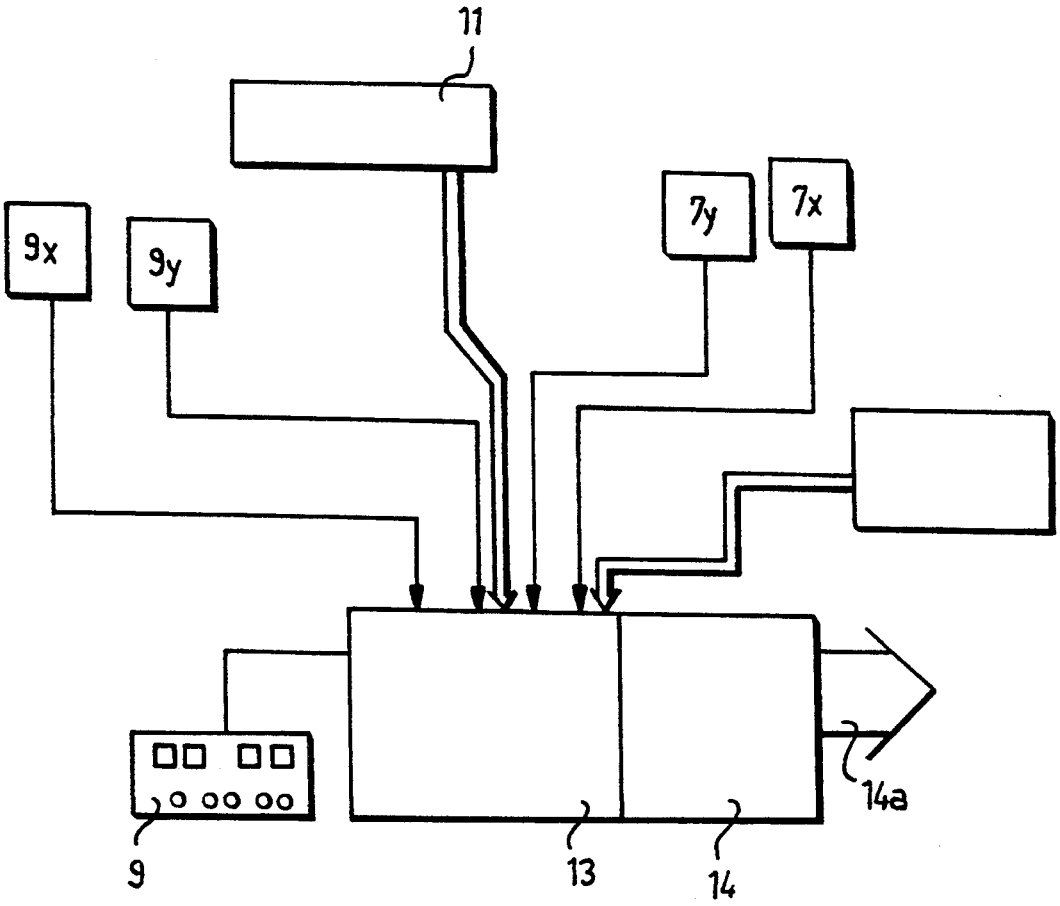
FIG. 5 is a block diagram indicating the manner of operation of the rock drilling equipment according to the invention.

FIG. 5 illustrates the operation of the equipment according to the invention by means of a block diagram, which shows how the gravity-operated angle sensors 7x and 7y of the feeding beam, the gravity-operated angle sensors 9x and 9y of the carrier, the joint sensors 1! of the boom, and the positional sensors 12 of the drill rod and the feeding beam are connected to a calculator unit 13. The distances between the boom joints and other geometrical data concerning the construction of the boom and the connections between the carrier and the boom are applied to the calculator unit in advance so that the calculator unit is able to calculate the required information on the basis of the position and angle data provided by the sensors as described above. The measurement and calculation of the direction and position of the boom with respect to the carrier are known per se and obvious to one skilled in the art e.g. on the basis of U.S. Pat. No. 4,514,796 or FR Patent 8200648, wherefore they are not described more closely herein. On the basis of the values calculated by the calculator unit 13, the actuating means of the boom and the feeding beam can be guided either automatically by means of a control unit 14 connected to the calculator unit 13 or by manually adjusting the control unit, whereby the control unit generates control signals 14a such that the feeding beam can be positioned in a desired position and direction. In the equipment and the guiding method according to the invention, the guiding and control circuits are in a way divided into two portions independent of each other. The first portion determines the position and movements of the carrier 1 and the boom 3 and the measurement and calculation of the position, direction and inclination of the end of the boom 3 close to the feeding beam, that is, a reference point defined in the boom end. This can be performed in such a way that the carrier 1 is always positioned in a horizontal position, whereby the end of the boom 3 is always positioned in accordance with the horizontal plane and its position can be calculated directly with respect to the carrier on the basis of the angle values of the joints and the geometry of the boom. Correspondingly, if the carrier is allowed to incline, the actual inclination of the carrier can be calculated on the basis of the inclination data given by the inclination sensors of the carrier, on the basis of which the direction, inclination and position of the boom end can be calculated. The second portion of the guiding and control system covers the adjustment of the inclination of the feeding beam 6 in such a way that the inclination planes of the feeding beam 6 are determined fixedly with respect to the boom in a predetermined manner, whereby the inclination sensors 7*x* and 7*y* of the feeding beam indicate the inclination of the feeding beam by means of this particular system of coordinates defined by the x and y planes. If the carrier 1 is in a horizontal position, the actual direction of the feeding beam can be calculated solely by means of the inclination sensors 7*x* and 7*y* of the feeding beam in the x, y system of coordinates or with respect to the line P defined by the force of gravity in the cylindrical coordinate system. If the carrier 1 is inclined, the inclination values obtained by the inclination sensors 7*x* and 7*y* of the feeding beam 6 with respect to the end of the boom 3, that is, with respect to the above-mentioned reference point, in the fixed system of coordinates can be corrected by calculation on the basis of the values calculated for the position and the inclination of the boom end on the basis of the inclination sensors of the carrier, thus again obtaining the inclination of the feeding beam in a rectangular system of coordinates determined by the line P defined by the force of gravity.

In place of the separate sensors 9*x* and 9*y* indicating the inclination of the carrier, it is possible to use the sensors 7*x* and 7*y* measuring the inclination of the feeding beam in such a way that the feeding beam and the boom are fixed in predetermined positions by means of mechanical limiters so as to determine the inclination of the carrier. When the boom and the feeding beam are in these fixed positions, the inclination of the carrier can be obtained directly from the inclination sensors of the feeding beam in the longitudinal and transverse planes of the carrier, whereby these values can be set in the memory of the calculator unit, and the correction calculations needed in the positioning of the feeding beam and the boom can then be made on the basis of the inclination values of the carrier set in the memory as long as the carrier is not displaced.

Even though the rock drilling equipment shown schematically in FIGS. 1 to 5 is such that the boom 3 can be turned only with respect to the carrier about a vertical axis and the boom is a continuous beam of a predetermined length without any joints, the boom may be of any known structure, provided that the angles of the joints of the boom can be measured by means of sensors attached to them and the geometric lengths of the boom are determined or, in the case of a telescopically extendible boom, measurable by means of a length sensor for the calculation. Similarly, the calculation can be effected mathematically in different ways especially when the inclination of the carrier is taken into account, whereby a mathematical reference point can be determined in the end of the boom, for instance, the position of the reference point with respect to the carrier and the direction of the plane of the carrier with respect to the force of gravity being determined. Thereafter the inclination of the feeding apparatus can be determined by calculating in a fixed coordinate system with respect to the reference point, or the inclination coordinate system of the feeding beam can be modified by calculation so that its vertical axis is parallel to the axis P of the force of gravity, whereafter the position of the feeding beam is determined in this modified coordinate system by calculating the angle values obtained by the sensors so that they correspond to the angle of inclination of the feeding beam.

The invention has been described and shown in the above description and in the accompanying drawings only by way of example and in a simplified form so as to facilitate the understanding of the invention. However, the invention is in no way restricted to the above description. The construction of the carrier and the construction and dimensions of the associated boom can be such as required. The control of the equipment and the alignment of the feeding beam and the drilling can be effected either automatically or manually, depending on the conditions and requirements in each particular case. When the position of the reference point of the boom is determined e.g. with respect to the plane of a row of holes to be drilled, the drilling depth can be determined by means of various measuring devices and reference means. The feeding beam can, for instance, be aligned in a desired drilling direction, whereafter it can be displaced in its longitudinal direction in such a way that a reference detector at the end of the feeding beam is aligned with e.g. a laser beam defining a reference plane in a manner known per se, thus indicating that the end of the feeding beam is at a certain height. The height level can, of course, be detected in some other way as well. Thereafter the feeding beam can be displaced in the drilling direction until it makes contact with the rock, and by measuring this displacement and subtracting it from the desired drilling depth with respect to the reference plane indicated by the above-mentioned laser device, it can be calculated what is the required length of a hole to be drilled at this particular point in order that the end of every hole would be at the same height with respect to the reference plane. This measuring and calculation of the drilling depth can also be connected to the calculator unit of the equipment so as to calculate the drilling depth of each hole and to control the drilling process by means of the control unit in a desired manner. The measuring of the movements of the feeding beam and the drilling machine thereby has to be performed by means of measuring sensors which provide sufficiently accurate information for the calculator unit.

It is claimed:

1. A method of aligning a feeding beam component of a rock drilling apparatus with a hole to be drilled wherein the inclination of the feeding beam is measured in two mutually perpendicular vertical measuring planes extending from a first common vertical axis by means of a pair of gravity operated sensors responsive to the position of the feeding beam, each sensor indicating the inclination of the feeding beam in the direction of one of the two mutually perpendicular planes, comprising the steps of:

a) measuring an angle of inclination of the feeding beam in the first vertical measuring plane by a first sensor responsive to movement of the feeding beam in said first vertical measuring plane;

b) measuring a second angle of inclination of the feeding beam in the second vertical measuring plane by a second sensor responsive to movement of the feeding beam in said second vertical measuring plane; wherein the presence of an angle of inclination in one of the first or second vertical measuring planes causes an error reading in the angle of inclination of the other of the first and second vertical measuring planes;

c) calculating actual first and second corrected angles of inclination for each of the first and second vertical measuring planes, taking into account said error reading; and d) aligning the feeding beam in a predetermined direction as a function of said first and second actual corrected angles of inclination.

2. The method of claim 1 wherein the feeding beam is mounted to a boom for rotation about a horizontal axis, and wherein said boom is mounted to a carrier for rotation about a vertical axis, and wherein step d) includes positioning an end of the boom to which the feeding beam is attached at a predetermined location above rock to be drilled as a function of a measured angle value between the bottom and the carrier, and aligning the feeding beam with drill holes to be drilled in the rock as a function of the first and second actual corrected angles of inclination calculated in step d).

3. The method of claim 2 and further including, prior to step d) the steps of:

measuring a third angle of inclination of the carrier in a third vertical measuring plane parallel to the first vertical measuring plane by a sensor responsive to movement of the carrier in said third vertical measuring plane;

measuring a fourth angle of inclination of the carrier in a fourth vertical measuring plane parallel to said second vertical measuring plane by a fourth sensor responsive to movement of the carrier in said fourth vertical measuring plane, and wherein said third and fourth vertical measuring planes are angled with respect to each other and perpendicular to a plane of the carrier; and wherein said third and fourth vertical measuring planes extend from a second common vertical axis; and further correcting said first and second actual angles of inclination by calculating the influence of the inclination of the carrier in said third and fourth vertical measuring planes on said actual first and second corrected angles of inclination.

4. The method of claim 3 wherein the inclination of the carrier is measured in such a way that the boom and the feeding beam are positioned in a predetermined position with respect to the carrier, and wherein the inclination of the carrier in said third vertical measuring plane extending in the direction of the longitudinal axis of the carrier and perpendicular to the plane of the carrier and correspondingly in said fourth vertical measuring plane extending in the transverse direction of the carrier and perpendicular to the plane of the carrier is measured by means of the first and second sensors.

5. The method of claim 2 wherein the direction of the feeding beam is indicated after calculation as a turning angle about said vertical axis extending through the end of the boom close to the feeding beam and as a direction angle in a plane defined by the turning angle and said vertical axis.

6. The method of claim 2 wherein said first and second sensors are arranged to measure the inclination of the feeding beam relative to said first and second vertical measuring planes in such a way that said first sensor measures inclination of the feeding beam in said first vertical measuring plane extending longitudinally of the boom and perpendicular to the plane of the carrier between a first pivot axis transverse to the feeding beam and a second pivot axis perpendicular to the first pivot axis, whereby turning of the feeding beam about the second pivot axis does not affect the first sensor, and wherein the second sensor is arranged to measure the inclination of the feeding beam with respect to the second pivot axis in said second vertical measuring plane and the plane of the carrier whereby the second angle of inclination obtained by the second sensor is corrected by calculating said angle on the basis of the inclination of the feeding beam measured in said first vertical measuring plane.

* * * * *